United States Patent [19]

Frelin et al.

[11] 4,313,769

[45] Feb. 2, 1982

[54] COATING SOLUTION FOR METAL SURFACES

[75] Inventors: Frank J. Frelin, Norristown; Timm L. Kelly, Oreland; Anthony J. Malloy, Willow Grove, all of Pa.

[73] Assignee: Amchem Products, Inc., Ambler, Pa.

[21] Appl. No.: 165,734

[22] Filed: Jul. 3, 1980

[51] Int. Cl.[3] ..... C23F 7/06

[52] U.S. Cl. ..... 148/6.27; 148/6.14 R

[58] Field of Search ..... 148/6.27, 6.14 R

[56] References Cited

U.S. PATENT DOCUMENTS

| | | | |
|---|---|---|---|
| 4,054,466 | 10/1977 | King et al. | 148/6.27 |
| 4,148,670 | 4/1979 | Kelly | 148/6.27 |
| 4,191,596 | 3/1980 | Dollman | 148/6.27 |

OTHER PUBLICATIONS

Payne, Organic Coating Technology, vol. 1, (1954), John Wiley & Son, pp. 554–556.

*Primary Examiner*—Ralph S. Kendall

*Attorney, Agent, or Firm*—Alexis Barron

[57] ABSTRACT

In an acidic aqueous coating solution which contains zirconium, hafnium or titanium, and fluoride and which is effective in forming on an aluminum surface a non-chromate coating to which overlying coatings adhere tightly and which is corrosion resistant and resists being discolored when subjected to hot water, the improvement comprising including in said coating solution a surfactant in an amount such that a coating formed from the surfactant-containing coating solution has an improved tendency to resist being discolored by hot water.

34 Claims, No Drawings

COATING SOLUTION FOR METAL SURFACES

FIELD OF THE INVENTION

This invention relates to the application to metallic surfaces of coatings which are corrosion resistant and to which overlying coatings such as those formed from paints, inks, and lacquers adhere tightly. More particularly, this invention relates to acidic aqueous coating solutions which form on aluminum surfaces the aforementioned types of coatings and coating solutions which are free of toxic materials such as chromates and ferricyanide.

Certain aspects of the present invention will be described in connection with the coating of aluminum cans. The invention has, nevertheless, broader applicability.

Corrosion resistant coatings which are applied to aluminum cans should be uniformly clear and colorless so that the coated cans have the bright shiny natural appearance of the underlying aluminum. This bright shiny natural appearance is desired in the final product even though portions of the can may be covered with overlying coatings formed from paints, lacquers, inks, etc., and hereinafter referred to as "siccative coatings". The corrosion resistant coatings should also have properties such that the overlying coatings, which are decorative or functional in nature, adhere thereto tightly and strongly.

Another property that coated aluminum cans should have is the ability to resist discoloration when the coated can is subjected to moderately hot water, for example, water having a temperature within the range of about 140° F. to about 170° F. This occurs in operations referred to in industry as "Pasteurization" of the cans. This treatment has a tendency to cause an uncoated or an inadequately coated aluminum surface to blacken or otherwise discolor thereby leaving the can with an unattractive appearance. The term "corrosion resistance" is used herein, unless otherwise specifically stated, to mean that the coated surface resists blackening or other discoloration when exposed to the aforementioned hot water or boiling water treatment.

In recent years there has been an industry-wide switch from hexavalent chromium-based coating compositions to coating compositions which do not contain this material, the use of which creates, in general, waste disposal problems. This invention relates to the provision of an aqueous coating solution which is capable of forming on an aluminum surface a non-chromate coating, including particularly a coating which is uniformly clear and colorless in appearance, and which is corrosion resistant and adheres excellently to overlying coatings, and which possesses other properties expected of compositions which are used in industrial applications for the coating of aluminum cans and other aluminum articles.

REPORTED DEVELOPMENTS

Recent developments in the industry are exemplified by the disclosures of the following: published UK Patent Application GB No. 2,014,617 A; U.S. Pat. Nos. 4,017,334; 3,964,936; and 4,148,670; and U.S. patent application Ser. No. 107,017, filed Dec. 26, 1979; the disclosures of each of the aforementioned incorporated herein by reference, and the last three mentioned being assigned to the same assignee as the present development.

Compositions which are the subject of the aforementioned are described as being capable of forming non-chromate coatings on aluminum surfaces and each is acidic and includes, as essential ingredients, a fluoride-containing compound and variously either a zirconium-titanium- or hafnium-containing compound. Phosphate is described as an additional essential constituent of the composition of the '670 patent and both phosphate and tannin are described as additional essential constituents of the composition of the '334 patent. A polyhydroxy compound is described as an optional ingredient of the phosphate-containing composition of the '670 patent and as an additional essential constituent of the phosphate-free composition described in the '017 application.

The present invention relates to the modification of the basic fluoride-containing and metal-containing (Zr, Ti or Hf) acidic aqueous coating solutions of the type described in the aforementioned documents to provide a composition, the use and/or formulation of which provides certain advantages, as described below.

BRIEF DESCRIPTION OF THE INVENTION

In accordance with the present invention, it has been found that the addition of a surfactant to an acidic aqueous coating solution containing one or more of zirconium, titanium or hafnium and fluoride provides several beneficial effects. The surfactant-containing composition can be used to form on aluminum surfaces uniformly clear colorless coatings which have excellent corrosion resistant properties, which adhere well to the aluminum substrate and which comprise an underlying surface to which overlying siccative coatings adhere tightly.

Several of the advantages which flow from the use of the present invention relate to the use of water-based compositions from which there are formed the siccative coatings, which overlie coatings formed from the composition of the present invention. By way of background, it is noted that there has been a relatively recent trend in the industry away from the use of organic solvent-based coating compositions and to the use of water-based coating compositions. Industry experience has shown that coatings formed from water-based compositions do not tend to adhere as well to underlying coatings of the aforementioned Zr, Ti or Hf type as coatings formed from organic solvent-based compositions. For example, aforementioned U.S. patent application Ser. No. 107,017 discloses that siccative coatings formed from water-based compositions do not tend to adhere as well to underlying coatings formed from the phosphate-containing compositions described in aforementioned U.S. Pat. No. 4,148,670 as those formed from organic solvent-based compositions. The '017 application discloses that coatings formed from phosphate-free coating compositions containing Zr or Hf and fluoride, as well as a polyhydroxy compound, provide an excellent adherent base for siccative coatings formed from water-based compositions.

It has been observed, however, that the corrosion resistance of coatings formed from compositions of the type described in the '017 application can tend to vary, depending on the type of water used in preparing the compositions of the '017 application. The corrosion resistant properties are better when the coatings are formed from compositions prepared from hard water than when they are formed from compositions prepared from soft water. As will be described more fully below, it appears that the relatively low calcium concentration in soft water affects adversely the corrosion resistant properties of the coatings. To state it otherwise, the relatively high concentration of calcium in hard water improves the corrosion resistance of the coatings.

The surfactant-containing compositions of the present invention have the advantage that they can be used to form coatings which have excellent corrosion resistance irrespective of whether the coating composition is prepared from hard or soft water.

The term "surfactant" is used herein to mean a material which when used in a small amount is capable of reducing markedly the surface tension of water. For example, the presence of a little as 2 ppm of surfactant dissolved in water can reduce the surface tension of water by more than one-third of its normal value. Of the various classes of surfactants that can be used (anionic, cationic, nonionic and amphoteric), the use of a nonionic surfactant is preferred in accordance with the present invention.

The coating solution of the present invention is capable of forming effectively the aforementioned types of coatings on an aluminum surface in the absence of toxic materials or materials of the type which create waste disposal problems, including, for example, hexavalent chromium, ferricyanide, ferrocyanide, manganese, iron, cobalt, nickel, molybdenum, and tungsten. Accordingly it is not necessary to add to the coating solution of the present invention materials which, if added, would mandate the effluents comprising the solution be treated specially before the effluent is discharged to the environment or to a sewage disposal plant.

DETAILED DESCRIPTION OF THE INVENTION

The acidic aqueous coating solution can be prepared from a variety of compounds which contain the aforementioned essential ingredients, zirconium, titanium, and/or hafnium and fluoride and which are soluble in the solution.

As to the source of the zirconium, titanium or hafnium, there can be used soluble fluozirconate, fluotitanate or fluohafnate compounds such as, for example, acids (fluozirconic, fluotitanic, and fluohafnic) thereof and ammonium and alkali metal fluozirconates, fluotitanates, and fluohafnates. The coating solution can be prepared also from metallic fluorides such as zirconium fluoride ($ZrF_4$), titanium fluoride ($TiF_3$, $TiF_4$), and hafnium fluoride ($HfF_4$). In addition, the coating solutions can be prepared from a mixture of soluble compounds, one of which contains zirconium, titanium, or hafnium, and the other of which contains fluoride. Examples of such compounds are water soluble salts comprising nitrates and sulfates of Zr, Ti or Hf (for example, zirconium nitrate, zirconium sulfate, titanium (iv) sulfate, hafnium nitrate), and hydrofluoric acid and water soluble salts thereof, for example, ammonium and alkali metal salts.

Satisfactory coatings can be formed from coating solutions containing as little as about $0.5\times10^{-3}$ m/l of either Zr, Ti, or Hf (about 0.05 g/l of Zr, about 0.02 g/l of Ti, and about 0.09 g/l of Hf). When utilizing a mixture of one or more of Zr, Ti or Hf, the total of the amounts of the metals should be at least about $0.5\times10^{-3}$ m/l. However, as will be explained below, greater amounts of these ingredients may be required to produce satisfactory coatings depending on other parameters of the coating process.

Zirconium, titanium, or hafnium can be used in amounts up to their solubility limits in the acidic aqueous coating solution. The solubility limits of the ingredients will depend on other parameters of the coating solution, including particularly, the acidity of the coating solution, the amount of fluoride in the coating solution, and the amounts of optional ingredients that might be used. These parameters should be controlled so that the formation of zirconium, titanium, or hafnium precipitate is avoided. The formation of such precipitate is undesirable for several reasons. Precipitation depletes the amounts of the ingredients. Also, the deposition on the coated aluminum surface of precipitate can adversely affect the coating properties. In addition, the formation and accumulation of any type of precipitate can tend to interfere with the application of the coating solution. For example, it can clog spray nozzles. If precipitation is encountered in a specific application, the pH of the coating solution should be lowered, and/or the amount of fluoride can be increased.

As to the fluoride concentration, the minimum concentration should be that which is sufficient to combine with all of the zirconium, titanium, or hafnium to form a soluble complex therewith, for example, a fluozirconate, fluotitanate, or fluohafnate. Accordingly the minimum amount of fluoride is dependent on the amount of zirconium, titanium, or hafnium in the solution. In general, at least about 4 moles of fluoride per mole of Zr, Ti or Hf is necessary to prevent precipitation of such metals.

Other considerations respecting the minimum fluoride concentration should be taken into account in any application in which a coating solution which has been contacted with aluminum is reused for contact with additional aluminum. By way of explanation, it is noted that the coating solution of the present invention dissolves aluminum. Thus, in an application in which the aluminum is contacted with the coating solution by immersing it in a bath of the coating solution, there is a build-up in concentration of dissolved aluminum in the bath. Similarly, if spraying or flow coating techniques are used for contacting the aluminum, and excess or unreacted solution is recycled to the bath of solution, there is a build-up of dissolved aluminum in the bath. In oder to deter or prevent adverse effects on the coating process as a result of a build-up of aluminum in the coating solution, the coating solution should contain sufficient amount of fluoride to complex the dissolved aluminum. This is important for the satisfactory operation of a continuous coating process. The amount of fluoride needed will depend on the extent to which aluminum builds up in the coating solution. And this in turn depends on various factors such as the shape of the aluminum surface being treated and the manner in which the surface is contacted with the solution.

Any material which is soluble in the coating solution and which is a source of fluoride capable of complexing aluminum and which does not contain a constituent which adversely affects the coating process can be used. However, if fluoride is added as a complex fluoride of titanium, zirconium, or hafnium, there should also be added to the solution another material which is a source of fluoride for complexing aluminum which builds up as the process is continued. The amount of fluoride available from hydrolysis of such complex fluoride may not be sufficient to complex the aluminum, and the extent of hydrolysis may be such that uncomplexed zirconium, titanium, or hafnium will precipitate as undesirable oxide precipitate. By utilizing another material which will readily provide sufficient fluoride for complexing the aluminum, the aforementioned is avoided. Examples of such materials are hydrofluoric acid, salts thereof, $NH_4F.HF$, alkali metal bifluorides, $H_2SiF_6$ and $HBF_4$, the last mentioned being preferred.

From a practical standpoint, the coating solution should contain, when operating on an industrial scale, an excess of fluoride, that is, an amount above that complexed with aluminum and any other metal constituents in the solution that form complexes with the fluoride. Such excess fluoride is referred to herein as "available fluoride" and includes fluoride present as HF and fluoride ion, that is, F not associated with other materials in the solution. The available fluoride concentration is that found when a sample of the coating solution, diluted with a constant ionic strength buffer which contains 40.8 g/l of sodium acetate, 28.5 ml/l of glacial acetic acid and 58.0 g/l of sodium chloride in deionized water and adjusted to a pH within the range of 5.0 to 5.3 with NaOH, is tested with an Orion pH meter (model No. 701A) having an Orion fluoride ion specific electrode (model No. 90-01). A coating solution which contains available fluoride is one in which fluoride is available to complex with aluminum.

The upper concentration of available fluoride is that which does not result in undue etching of the aluminum surface. Undue etching tends to produce a dull and frosty surface. It has also been observed that the presence of an excess of available fluoride can affect adversely the corrosion resistant and adherent properties of the coating, and may cause precipitation of calcium or other metal ions which may be present in the coating solution, for example, as introduced when hard water is employed in preparing the composition. By way of guidelines, it is recommended that the concentration of available fluoride be no greater than about 500 ppm.

As mentioned above, it is preferred that the surfactant for use in the present invention be selected from the nonionic class of surfactants. Although in some cases noticeable improvements will be observed when using about 10 ppm of surfactant, it is preferred to use the surfactant in an amount of about 20 to about 100 ppm. Higher amounts, for example, up to about 500 ppm, can be used, but in general, little or no additional improvements are realized at higher concentrations.

The pH of the coating solution can vary over a wide range, for example, about 1.5 to about 5, with the influence of the surfactant in the coating solution being related to various of the other parameters of the solution. Improvements in corrosion resistance attributed to the surfactant are observed particularly at a pH within the range of about 3.5 to about 4.5. The pH of the solution may be adjusted by using appropriate amounts of preferably nitric acid or ammonium hydroxide, although other acid or base which will not interfere with the coating process can be used.

Other materials can be added optionally to the coating solution of the present invention. For example, there can be used a soluble polyhydroxy compound as described in the aforementioned '017 application. Any compound soluble in the coating solution which when dissolved yields polyhydroxy compounds having seven or fewer carbon atoms and which does not interfere with the ability of the coating solution to coat or provide coatings having the desired corrosion resistance and paint adherence may be used. Examples of such compounds include gluconic acid, salts of gluconic acid, sodium glucoheptonate, sorbitol, mannitol, dextrose, ethylene glycol, and glycerine. Particularly preferred polyhydroxy compounds are gluconic acid and alkali metal and ammonium salts thereof. Any compound soluble in the coating solution which yields gluconate and/or gluconic acid may be used. Examples of such compounds are stable gluconolactones such as glucono-delta-lactone and glucono-gamma-lactone. At least about 40 ppm of the polyhydroxy compound can be used. Although higher amounts can be used, it is recommended that the polyhydroxy compound be present in an amount no greater than about 1000 ppm. Preferably about 40 to about 400 ppm of the polyhydroxy compound are used.

Examples of other materials which can be added optionally to the coating solution of the present invention are those which have been reported heretofore as being useful in Zr, Ti, or Hf and fluoride-containing compositions. For example, aforementioned U.S. Pat. No. 3,964,936 discloses the use of materials which are a source of boron in an amount of at least about 10 ppm and ranging up to about 200 ppm. In addition, tannin is another optional ingredient that can be added to the solution in concentrations of at least about 25 ppm and ranging up to about 10 g/l (see U.S. Pat. No. 4,017,334 and U.K. Patent Application GB No. 2,014,617). And when using organic solvent-based coating compositions to form the overlying siccative coating, the solution of the present invention can include optionally phosphate in an amount of about 10 ppm to about 1000 ppm, as described in U.S. Pat. No 4,148,670.

Still other materials which can be added optionally to the coating solution of the present invention are various other acids including, for example, glutaric, ascorbic, maleic, and salicyclic. Such acids can be used in amounts of at least about 5 ppm and preferably within the range of about 100 to about 500 ppm to realize various advantages, including improving the adhesive properties of coatings formed from the solution.

Recommended coating solutions for use in the practice of this invention have a pH within the range of about 3.5 to about 4.5 and contain about $0.75\times10^{-3}$ to about $2\times10^{-3}$ m/l of zirconium and about 10 ppm to about 500 ppm of surfactant, and most preferably a pH within the range of about 3.7 to about 4.3 and contain $1\times10^{-3}$ to about $1.75\times10^{-3}$ m/l of zirconium and about 20 to about 100 ppm of surfactant, each of the aforementioned containing enough fluoride to complex all of the Zr present and dissolved aluminum.

The preferred source of both Zr and fluoride in the make-up composition is fluozirconic acid and nitric acid is used preferably to adjust the pH.

Amount ranges for ingredients comprising the composition have been described above. Considerations should be taken into account in formulating specific compositions for specific applications while working within the aforementioned ranges. When operating at a relatively high pH, relatively small amounts of zirconium, titanium and/or hafnium should be used to deter precipitation. When contacting the coating solution and the aluminum surface for a relatively short time, relatively high amounts of the aforementioned metals should be used. Similarly, when the temperature of contact between the coating solution and the aluminum surface is relatively low, relatively high amounts of ingredients should be used.

The coating solution of the present invention can be prepared conveniently by diluting an aqueous concentrate of the ingredients with an appropriate amount of water. The concentrate should be such that when a coating solution comprises about 0.5 to about 10 weight percent of the concentrate, the amounts of ingredients present in the coating solution are: (A) at least about $0.5\times10^{-3}$ m/l of one of more of zirconium, titanium, and hafnium; and (B) fluoride in an amount at least sufficient to combine with substantially all of the Zr, Ti, or Hf to form a complex therewith, and also (C) at least about 10 ppm of surfactant.

In a continuous coating operation, it is important to properly replenish the solution in order to maintain the effectiveness of the coating process. Work done in connection with the development of the present invention has shown that various of the ingredients comprising the solution are depleted as a result of reactions which occur during the formation of the coating, and they should be replaced. Available fluoride is consumed as a result of complexing with aluminum, hydrogen is consumed as the aluminum surface is oxidized, and the metal (Zr, Ti or Hf) is consumed also. In addition, ingredients are depleted as a result of drag-out of the solution on the aluminum surface. Work has also shown that the rate of depletion of ingredients is related to the shape of the surface being coated and the manner in which the coating solution is contacted with the aluminum surface. For example, when spraying cans, there is a greater drag-out loss than when spraying aluminum strip.

The coating solution can be replenished as the ingredients are depleted. This may be accomplished by either monitoring the amount of each ingredient in the coating solution and adding this ingredient as it is depleted or it can be accomplished by adding thereto an aqueous concentrate of the ingredients.

The replenishing ingredients should be added to the solution to maintain the ingredients thereof in effective operating amounts. In an application in which there is a build-up of aluminum in the coating solution, it is recommended that the replenishing composition contain a relatively high proportion of fluoride for complexing the aluminum. Preferred source of available fluoride for use in the replenishing of the coating bath is $HBF_4$ or HF. The following is a recommended aqueous concentrate for replenishing the coating solution.

(A) about 0.05 mole/liter to about 0.5 mole/liter of zirconium, titanium and/or hafnium; and (B) about 0.2 mole/liter to about 10 moles/liter of fluoride.

The coating solution should be applied to a clean aluminum surface. Available cleaning compositions such as alkaline or acid cleaning solutions can be used to clean the aluminum surface according to conventional techniques.

When coating drawn and ironed aluminum cans it is preferred to subject the cans to a cleaning solution comprising an acidic aqueous solution of a mixture of HF, $H_2SO_4$ and surfactant, for example, solutions such as those described in U.S. Pat. Nos. 4,009,115; 4,116,853; and 4,124,407, each assigned to the same assignee as the present invention, and the disclosures of which are incorporated herein by reference.

The coating solution can be applied to the aluminum surface by any suitable method. For example, the solution can be applied by spraying the aluminum surface, or the aluminum surface can be immersed in the solution, or it can be applied by roll or flow coating techniques or misting techniques. It is believed that the solution can be applied very economically by spraying. The solution can be used to coat individual articles such as, for example, cans, or it can be used to coat forms of aluminum, such as aluminum strip, which are subsequently fabricated into articles.

The temperature of the coating solution should be such that the reactive ingredients of the solution bond to the aluminum surface. In general, a temperature of at least about 90° F. is required to produce the desired degree of corrosion resistance, and temperatures of up to about 140° F. can be used. Preferably, the coating solution should have a temperature of about 110° F. to about 130° F. If the temperature of the coating solution is too high, a dull and frosty appearing surface can be obtained. The temperature at which this occurs depends on various of the parameters of the coating operation, including, for example, the time of contact of the solution with the aluminum surface and the reactivity of the solution which depends on pH and concentration of ingredients in the solution.

Desired coatings can be formed by contacting the coating solution and the aluminum surface for at least about 5 seconds, preferably at least about 15 seconds. The lower the temperature of the coating solution, the longer should be the contact time, and the higher the temperature of the solution, the shorter the contact time required. In general, it will be unnecessary to contact the surface with the coating solution for more than one minute.

Utilizing the coating solution of the present invention, it is possible to form coatings which are very uniform. This permits paint or ink to be applied evenly and with desired coverage to the coated aluminum surface. In the aluminum can industry, paint and ink coatings are applied to coated aluminum cans by an automatic roller coating machine in which paints and inks are applied to a roller and then to the surface of the coated can as the roller is rotated across the surface of the coated can. If the can has a non-uniform coating, the subsequently applied ink or paint composition may not cover the desired areas of the can.

After the coating solution has been applied to the aluminum surface, it should be water rinsed, including a final deionized water rinse. Rinsing with water that contains a small amount of dissolved solids may lead to a coating which has poor painting adhesive properties. In utilizing the present invention, it is not necessary to rinse the coated surface with an aqueous solution of chromium such as, for example, a hexavalent chromium solution.

After the coated surface has been water rinsed, or otherwise treated as described above, the coating should be dried. This can be done by any practical means, such as, for example, oven drying or forced circulation of hot air. Other available drying methods can be used.

After the coating has been applied, it can be subjected to sanitary or decorative coating operations which include, for example, applying to the coated surface siccative coatings. These coatings are usually applied after the aluminum surface has been coated, water-rinsed and dried. In some applications, the sanitary coating is applied after the water rinse and both the coating of the present invention and the sanitary coating are dried simultaneously.

Siccative coatings which comprise the functional and/or aesthetic coatings which overlie the coatings formed from the coating solution of the present invention are well known, of course, and can be formed from either water-based or organic solvent-based compositions.

In an application where aluminum cans are to be filled with beer, the cans are treated with the coating solution of the present invention and then sanitary and/or decorative coatings are applied. Thereafter, the cans are filled with beer and sealed, after which the beer-filled cans are usually subjected to pasteurization.

It is believed that the zirconium, titanium, or hafnium present in the coating solution of the present invention is present in a complexed form which is both soluble in the solution and reactive with the aluminum surface to form thereon a coating containing such metal without affecting the bright shiny appearance of the aluminum surface. Accordingly, the solution should be free of constituents which combine with the aforementioned metals to form compounds and/or complexes which precipitate from the solution and/or compounds or complexes which are not reactive with the aluminum surface or which are reactive, but in a manner such that the bright shiny appearance of the aluminum surface is altered.

The coating solution of the present invention can be used to coat surfaces of pure aluminum or alloys of aluminum, for example, aluminum alloys containing minor amounts of materials such as, for example, magnesium, manganese, copper and silicone. It is believed that one of the widest uses of the coating solution of the present invention will be the coating of aluminum surfaces which have a bright shiny appearance.

EXAMPLES

Examples below are illustrative of the practice of the present invention. Comparative examples are set forth also.

Unless stated otherwise, the aluminum surfaces treated with the solutions identified in the examples were drawn and ironed aluminum cans which were first degreased, as necessary, in an acidic aqueous cleaner containing sulfuric acid, hydrofluoric acid and detergent. Unless stated otherwise, the coating solutions were applied by spraying for about 20 seconds at a temperature of about 130° F. After treatment with the solutions identified in the examples, the aluminum surfaces were rinsed with tap water and then with deionized water, and thereafter dried in an oven for 3.5 minutes at about 400° F.

Thereafter, the aluminum cans were tested for corrosion resistance by subjecting them to a water stain resistance test simulating can exposure during commercial pasteurization processes. The test consisted of immersing the cans for a period of 30 minutes in a hot solution of distilled or deionized water containing 0.22 g/l of sodium bicarbonate, 0.082 g/l of sodium chloride, and 2.18 g/l of a water conditioner (Dubois 915, a proprietary product, supplied by Dubois Chemical Inc., which exhibits a total alkalinity of 5.8% $Na_2O$ and on analysis contains $NaNO_3$, carbonate, triethanolamine and dodecylphenyl polyethylene glycol). The solution was maintained at 150±5° F. during the test. After immersion, the cans were rinsed with tap water, dried with a paper towel and then examined for staining. A cleaned-only aluminum surface, when subjected to this test, turns black or brown after a few minutes. It will be seen from examples set forth below that prior treatment of aluminum surfaces with coating solutions of the present invention can result in the provision of coated surfaces which are not blackened or otherwise discolored or which resist blackening or other discoloration. The aluminum surfaces were rated as follows: 5, perfect—identical to a treated but untested surface; 4.5—very slight diminishing of the bright appearance of the surface; 4.0—very slight discoloration; 3.5—light discoloration, but commercially acceptable; 3.0—discoloration that is considered not commercially acceptable; 0—total failure, characterized by severe blackening.

The following acidic aqueous solution was prepared for use in connection with the first group of examples.

| | g/l |
|---|---|
| fluozirconic acid (100%) | 10.5 |
| aqueous ammonia (29 wt. %) | 5.9 |
| nitric acid (70 wt. %) | 9 |
| deionized water to make 1 liter | |

The above composition was prepared by combining an aqueous solution of 23.4 grams of 45 wt.% fluozirconic acid with a portion of the water, and thereafter the aqueous ammonia was added to the resulting solution. A white precipitate was formed, but it dissolved upon the addition of nitric acid. The resulting clear solution was diluted to 1 liter with deionized water. The resulting concentrate was used to prepare treatment solutions at 2.5% by volume in water comprising 2 parts deionized water and 1 part hard water. (In the examples, the term "hard water" refers to tap water from Ambler, Pa., which includes about 80 to about 100 ppm of calcium and has a conductivity of about 400 to about 600 mhos.) To this solution, there was added, in the amounts indicated in Table 1 below, a nonionic surfactant sold under the trademark Surfonic LF-17 by Jefferson Chemical Co., Inc. and which is reported to be a low foaming alkyl polyethoxylated ether. Solutions of varying acidity were prepared by adjusting the pH of the aforementioned base composition with appropriate amounts of an aqueous solution of 15% (w/v) ammonium carbonate or dilute nitric acid.

The water-stain resistance of aluminum cans coated with the compositions is reported in Table 1 below.

TABLE 1

| Ex. No. | Conc. of Surf., ppm | pH of Coating Solution | Water-stain Resistance Rating |
|---|---|---|---|
| C-1 | 0 | 3.5 | 3.3 |
| 1 | 5 | 3.5 | 3.6 |
| 2 | 10 | 3.5 | 3.6 |
| 3 | 20 | 3.5 | 4.1 |
| 4 | 40 | 3.5 | 4.1 |
| 5 | 80 | 3.5 | 4.2 |
| C-2 | 0 | 4 | 3.7 |
| 6 | 5 | 4 | 4.4 |
| 7 | 10 | 4 | 4.7 |
| 8 | 20 | 4 | 4.5 |
| 9 | 40 | 4 | 4.5 |
| 10 | 80 | 4 | 4.6 |
| C-3 | 0 | 4.5 | 4.3 |
| 11 | 5 | 4.5 | 4.4 |
| 12 | 10 | 4.5 | 4.7 |
| 13 | 20 | 4.5 | 4.8 |
| 14 | 40 | 4.5 | 4.7 |
| 15 | 80 | 4.5 | 4.7 |

The corrosion resistant improvements achieved over the pH range of 3.5 to 4.5 for the compositions evaluated in Table 1 are clearly shown. Other tests show that for the particular type composition evaluated in Table 1, the water-stain resistance of coatings formed from compositions with and without surfactant were about the same when the pH of the composition was about 2.5. Still other tests showed that for the particular type composition evaluated in Table 1, but prepared from deionized water only and containing 20 ppm of surfactant, improvements in water-stain resistance were achieved when the pH of the composition was in excess of 3.5, with substantial improvements being achieved at a pH of about 4.

The next group of examples shows the use of compositions of the type described in the first group of examples, but including also 0.1 g/l of gluconic acid which is effective in improving the water-stain resistance of the coated surface. Compositions of varying acidity and containing either the surfactant used in the compositions of the first group of examples or another surfactant were evaluated. Said other surfactant was a modified polyethoxylated straight chain alcohol which is considered to be a low-foaming material and which is sold under the trademark Triton DF-16 by Rohm and Haas Company. The specific compositions evaluated and the results of the testing are set forth in Table 2 below.

TABLE 2

| Ex. No. | Surfactant | Conc. of Surf., ppm | pH of Coating Solution | Water-stain Resistance Rating |
|---|---|---|---|---|
| C-4 | | 0 | 3 | 3.5 |
| 16 | LF-17 | 10 | " | 3.0 |
| 17 | " | 50 | " | 3.9 |
| 18 | " | 100 | " | 3.0 |
| 19 | " | 500 | " | 3.9 |
| 20 | DF-16 | 10 | " | 3.3 |
| 21 | " | 50 | " | 4.0 |
| 22 | " | 100 | " | 3.0 |
| 23 | " | 500 | " | 4.3 |
| C-5 | | 0 | 3.5 | 3.8 |
| 24 | LF-17 | 10 | " | 4.0 |
| 25 | " | 50 | " | 4.5 |
| 26 | " | 100 | " | 3.9 |
| 27 | " | 500 | " | 4.1 |
| 28 | DF-16 | 10 | " | " |
| 29 | " | 50 | " | 4.3 |
| 30 | " | 100 | " | 4.4 |
| 31 | " | 500 | " | 4.3 |
| C-6 | | 0 | 4.0 | 3.5 |
| 32 | LF-17 | 10 | " | 4.3 |
| 33 | " | 50 | " | 4.7 |
| 34 | " | 100 | " | 4.9 |
| 35 | " | 500 | " | 4.8 |
| 36 | DF-16 | 10 | " | 3.7 |
| 37 | " | 50 | " | 4.2 |
| 38 | " | 100 | " | 4.4 |
| 39 | " | 500 | " | 4.6 |

In addition to improvements in corrosion resistance, as exemplified by the test results reported above, the coating solutions of the present invention can be used to form coatings which adhere well to overlying siccative coatings formed from either water-based or organic-solvent coating compositions.

Work done in connection with the development of the present invention has shown that the hardness of make-up water has an influence on the water-stain resistance of aluminum coated with an acidic aqueous solution containing zirconium and fluoride. The harder the water, the better the water-stain resistance, and conversely, the softer the water, the poorer the water-stain resistance. Work has shown also that the water-stain resistance of aluminum cans coated with an acidic aqueous solution containing zirconium and fluoride, and prepared from deionized water of from soft water, can be improved by adding to the solution calcium in amounts which in effect convert the deionized or soft water to hard water which, as mentioned above, generally contains about 80 to about 100 ppm of calcium. (A typical example of soft water analyzes about 20 to about 25 ppm of calcium and has a conductivity of about 130 to about 200 μmhos.) Thus, the use of calcium is another approach to improving the water-stain resistance of the coatings. However, the use of calcium on an industrial basis is accompanied by the disadvantage that it tends to form precipitates with fluoride and zirconium, for example, calcium fluozirconate, in aqueous concentrates, which typically would be used to make-up or replenish an operating bath of the composition.

The next group of examples shows the use of other materials in combination with Zr,F and surfactant.

EXAMPLES 40 to 43

To an aqueous concentrate of the type described above and diluted with a sufficient amount of water (two parts deionized water and one part hard water) to yield a coating solution containing 2.5% by volume of the concentrate and 20 ppm of Surfonic LF-17, four different solutions are prepared, each containing 0.1 g/l of one of the following ingredients: glutaric acid, ascorbic acid, maleic acid and salicylic acid. The pH of each of the compositions is 3.5 and each is used in treating aluminum cans in the manner described above in connection with the preceding examples. For all of the cans treated in this way, water stain resistant ratings are above 3.5 and improved adhesion is exhibited when the cans are painted with either PPG CE 3179-2 Inmont S145-121, water-based coating compositions, or with Clements P1099-7A or Clements P550-G, organic solvent based coating compositions.

EXAMPLES 44 to 47

Other compositions are also formulated by including $0.5\times10^{-3}$ m/l of gluconic acid in each of the compositions of Examples 40 to 43 above. Coatings formed from such compositions exhibited improved adhesion with respect to top coats formed from various water-based resin coating compositions.

In summary, it can be said that the present invention provides the means for forming a non-chromate coating which is colorless and clear without modifying the appearance of the aluminum surface. The coated surface resists discoloration even after being subjected to hot or boiling water and has excellent adhesion to overlying siccative coatings.

We claim:

1. An acidic aqueous coating solution which is effective in forming a non-resinous, non-chromate, corrosion-resistant coating on an aluminum surface, said solution consisting essentially of a metal selected from the group consisting of zirconium, titanium and hafnium and mixtures of two or more of said metals, said metal being present in an amount of at least about $0.5\times10^{-3}$ m/l, fluoride in an amount at least sufficient to combine with all of said metal, and surfactant in an amount such that the coating formed from said solution has an improved tendency to resist being discolored by hot water.

2. The coating solution of claim 1 wherein the surfactant is present in an amount of at least about 10 ppm.

3. The coating solution of claim 2 having a pH of about 3.5 to about 4.5 and including about $0.75\times10^{-3}$ to about $2\times10^{-3}$ m/l of zirconium and about 10 ppm to about 500 ppm of surfactant.

4. The coating solution of claim 3 wherein the amount of fluoride is at least about 4 moles per mole of said metal.

5. The coating solution of claim 1 including at least about 10 ppm of boron.

6. The coating solution of claim 5 wherein the boron is present in an amount of from about 10 to about 200 ppm.

7. The coating solution of claim 1 including tannin.

8. The coating solution of claim 1 including one or more of glutaric, ascorbic, maleic, or salicylic acid.

9. The coating solution of claim 1 or 5 including a polyhydroxy compound having no more than about 7 carbons.

10. The coating solution of claim 9 wherein said compound is gluconic acid.

11. An acidic, aqueous coating solution which is effective in forming a non-resinous, non-chromate, corrosion resistant coating on an aluminum surface, said solution consisting essentially of zirconium in an amount of from about $1\times10^{-3}$ to about $1.75\times10^{-3}$ m/l, surfactant in an amount of from about 20 to about 100 ppm, fluoride in an amount of at least about 4 moles per mole of zirconium, and boron in an amount of from about 10 to about 200 ppm, said solution having a pH within the range of about 3.7 to about 4.3.

12. The coating solution of claim 11 wherein the surfactant is a nonionic surfactant.

13. The coating solution of claim 12 wherein the pH is about 4.

14. The coating solution of claim 12 wherein the source of fluoride is $HBF_4$.

15. The coating solution of claim 1 or 11 including nitric acid.

16. The coating solution of claim 3, 11, or 13 wherein the source of both the zirconium and fluoride is fluozirconic acid.

17. The coating solution of claim 1, 3, or 13 wherein the surfactant is a low-foaming alky polyethoxylated ether.

18. The coating solution of claim 1, 3, or 13 wherein the surfactant is a low-foaming polyethoxylated straight chain alcohol.

19. A method of coating an aluminum surface comprising contacting the surface with the coating solution of claim 1, 2, 3, 4, 5, 6, 7, 8, 11, 12, 13, or 14.

20. A method of coating an aluminum surface comprising contacting the surface with the coating solution of claim 9.

21. A method of coating an aluminum surface comprising contacting the surface with the coating solution of claim 15.

22. A method of coating an aluminum surface comprising contacting the surface with the coating solution of claim 16.

23. A method of coating an aluminum surface comprising contacting the surface with the coating solution of claim 17.

24. A method of coating an aluminum surface comprising contacting the surface with the coating solution of claim 18.

25. A method for coating aluminum cans comprising contacting the cans with the solution of claim 1, 3, 11, or 13.

26. An acidic aqueous concentrate such that an aqueous coating solution containing about 0.5 to about 10 weight percent of the concentrate is effective in forming a non-resinous, non-chromate, corrosion-resistant coating on an aluminum surface, said coating solution consisting essentially of:

(A) at least about $0.5\times10^{-3}$ m/l of one or more of zirconium, titanium, and hafnium;

(B) fluoride in an amount at least sufficient to combine with substantially all of the zirconium, titanium, or hafnium to form a complex therewith; and also (C) at least about 10 ppm surfactant.

27. An aqueous concentrate for replenishing a coating solution of the type defined in claim 1, 3, or 11 and consisting essentially of:

(A) about 0.05 m/l to about 0.5 m/l of one or more of zirconium, titanium, and hafnium;

(B) about 0.2 m/l to about 10 m/l of fluoride; and (C) about 1 to about 100 g/l of surfactant.

28. An acidic aqueous coating solution which is effective in forming a non-resinous, non-chromate, corrosion-resistant coating on an aluminum surface, said solution consisting essentially of a metal selected from the group consisting of zirconium, titanium and hafnium and mixtures of two or more of said metals, said metal being present in an amount of at least about $0.5\times10^{-3}$ m/l, fluoride in an amount at least sufficient to combine with all of said metal, and surfactant in an amount such that the coating formed from said solution has an improved tendency to resist being discolored by hot water, said solution having a pH within the range of about 3.5 to about 4.5.

29. An acidic aqueous coating solution which is effective in forming a non-resinous, non-chromate, corrosion-resistant coating on an aluminum surface, said solution consisting essentially of about $0.75\times10^{-3}$ to about $2\times10^{-3}$ m/l of zirconium, fluoride in an amount at least sufficient to combine with all of said zirconium, and surfactant in an amount such that the coating formed from said solution has an improved tendency to resist being discolored by hot water.

30. An acidic aqueous coating solution which is effective in forming a non-resinous, non-chromate, corrosion-resistant coating on an aluminum surface, said solution consisting essentially of a metal selected from the group consisting of zirconium, titanium, and hafnium and mixtures of two or more of said metals, said metal being present in an amount of at least about $0.5\times10^{-3}$ m/l, fluoride in an amount at least sufficient to combine with all of said metal, and about 10 to about 500 ppm of a nonionic surfactant.

31. An acidic aqueous coating solution which is effective in forming a non-chromate, corrosion-resistant coating on an aluminum surface, said solution consisting essentially of zirconium in an amount of at least about $0.5\times10^{-3}$ m/l, fluoride in an amount at least sufficient to combine with all of said metal, and surfactant in an amount such that the coating formed from said solution has an improved tendency to resist being discolored by hot water.

32. An acidic aqueous coating solution which is effective in forming a non-chromate, corrosion-resistant coating on an aluminum surface, said solution consisting essentially of zirconium in an amount of at least about $0.5\times10^{-3}$ m/l, fluoride in an amount at least sufficient to combine with all of said metal, and surfactant in an amount of at least about 10 ppm.

33. The coating solution of claim 32 wherein the surfactant is present in an amount of from about 10 ppm to about 500 ppm.

34. An acidic aqueous concentrate such that an aqueous coating solution containing about 0.5 to about 10 weight percent of the concentrate is effective in forming a non-chromate, corrosion-resistant coating on an aluminum surface, said coating solution consisting essentially of:

(A) at least about $0.5\times10^{-3}$ m/l zirconium;

(B) fluoride in an amount at least sufficient to combine with substantially all of said zirconium to form a complex therewith; and also (C) at least about 10 ppm surfactant.

* * * * *